US009624930B2

(12) United States Patent
Gahlot et al.

(10) Patent No.: US 9,624,930 B2
(45) Date of Patent: Apr. 18, 2017

(54) MULTIPHASE PUMPING SYSTEM

(71) Applicant: GE Oil & Gas ESP, Inc., Oklahoma City, OK (US)

(72) Inventors: Vishal Gahlot, Moore, OK (US); Mukul K. Tyagi, Edmond, OK (US)

(73) Assignee: GE Oil & Gas ESP, Inc., Oklahoma City, OK (US)

( * ) Notice: Subject to any disclaimer, the term of this patent is extended or adjusted under 35 U.S.C. 154(b) by 1092 days.

(21) Appl. No.: 13/722,877

(22) Filed: Dec. 20, 2012

(65) Prior Publication Data

US 2014/0178190 A1 Jun. 26, 2014

(51) Int. Cl.

| | |
|---|---|
| ***F04D 1/00*** | (2006.01) |
| ***F04D 7/04*** | (2006.01) |
| ***F04D 29/22*** | (2006.01) |
| ***F04D 13/08*** | (2006.01) |

(52) U.S. Cl.

CPC ..... *F04D 1/00* (2013.01); *F04D 7/045* (2013.01); *F04D 13/08* (2013.01); *F04D 29/2288* (2013.01)

(58) Field of Classification Search

CPC ..... F04D 7/045; F04D 29/2288; F04D 31/00; F04D 29/284; F04D 13/08

See application file for complete search history.

(56) References Cited

U.S. PATENT DOCUMENTS 1,622,930 A * 3/1927 Von Karman ..... F01D 5/048 415/140
3,204,562 A * 9/1965 Norquist ..... F04D 1/066 415/219.1
3,316,849 A 5/1967 Cooper et al.
3,867,056 A * 2/1975 Carle ..... F04D 1/06 415/169.1
4,936,744 A 6/1990 Dosch et al.

(Continued)

FOREIGN PATENT DOCUMENTS

DE 2357305 A1 5/1975

OTHER PUBLICATIONS

PCT Search Report and Written Opinion issued May 16, 2014 in connection with corresponding PCT Patent Application No. PCT/US2013/074083.

(Continued)

*Primary Examiner* — Richard Edgar
*Assistant Examiner* — Jesse Prager
(74) *Attorney, Agent, or Firm* — Crowe & Dunlevy, P.C.

(57) ABSTRACT

A centrifugal pump has a gas accumulation reduction system to reduce the risk of gas locking caused by the accumulation of gas at the inlet of the impeller. The gas accumulation reduction system includes: (i) one or more diffuser ports extending through the hub of a diffuser; and (ii) one or more recirculation passages extending through the hub of an impeller. The recirculation passages are in fluid communication with the one or more diffuser ports to permit the recirculation of a portion of pumped fluid through the stage. Additionally, a centrifugal pump that includes at least one turbomachinery stage. The stage includes a rotatable impeller that has an impeller hub with a centrally disposed eye and a plurality of impeller vanes. The impeller is variously configured to encourage mixing of two-phase fluids at the eye of the impeller hub.

1 Claim, 11 Drawing Sheets

(56) References Cited

U.S. PATENT DOCUMENTS

| | | | | |
|---|---|---|---|---|
| 5,628,616 | A | 5/1997 | Lee | |
| 6,299,406 | B1 | 10/2001 | Yu et al. | |
| 6,382,919 | B1 | 5/2002 | Charron | |
| 6,676,366 | B2 * | 1/2004 | Kao | F04D 29/2288 415/1 |
| 6,893,207 | B2 | 5/2005 | Kao | |
| 7,094,016 | B1 | 8/2006 | Zaher | |
| 7,150,600 | B1 | 12/2006 | Vennat | |
| 7,343,967 | B1 | 3/2008 | Floyd | |
| 7,357,186 | B1 | 4/2008 | Berry | |
| 7,461,692 | B1 | 12/2008 | Wang | |
| 7,462,225 | B1 | 12/2008 | Ketter et al. | |
| 7,549,837 | B2 | 6/2009 | Hackworth et al. | |
| 7,857,577 | B2 * | 12/2010 | Eslinger | F03G 7/00 415/1 |
| 8,141,625 | B2 * | 3/2012 | Reid | E21B 43/128 166/105.5 |
| 2003/0170112 | A1 | 9/2003 | Kao | |
| 2005/0186065 | A1 | 8/2005 | Wilson et al. | |
| 2009/0155064 | A1 | 6/2009 | Brown et al. | |
| 2010/0098525 | A1 | 4/2010 | Guelich | |
| 2010/0319916 | A1 | 12/2010 | Bicerano et al. | |
| 2010/0319926 | A1 * | 12/2010 | Reid | E21B 43/128 166/372 |
| 2014/0030055 | A1 * | 1/2014 | Jayaram | F04D 1/00 415/1 |
| 2014/0050570 | A1 * | 2/2014 | Jayaram | F04D 13/08 415/169.1 |

OTHER PUBLICATIONS

PCT Invitation to Pay Additional Fees and Partial International Search dated Mar. 25, 2014 issued in connection with corresponding PCT Application No. PCT/US2013/074083.

* cited by examiner

MULTIPHASE PUMPING SYSTEM

FIELD OF THE INVENTION

This invention relates generally to the field of downhole turbomachines, and more particularly to downhole turbomachines optimized for reducing phase separation of pumped fluids.

BACKGROUND

Submersible pumping systems are often deployed into wells to recover petroleum fluids from subterranean reservoirs. Typically, a submersible pumping system includes a number of components, including an electric motor coupled to one or more high performance pump assemblies. Production tubing is connected to the pump assemblies to deliver the petroleum fluids from the subterranean reservoir to a storage facility on the surface. The pump assemblies often employ axially and centrifugally oriented multi-stage turbomachines.

Most downhole turbomachines include one or more impeller and diffuser combinations, commonly referred to as "stages." The impellers rotate within adjacent stationary diffusers. A shaft keyed only to the impellers transfers mechanical energy from the motor. During use, the rotating impeller imparts kinetic energy to the fluid. A portion of the kinetic energy is converted to pressure as the fluid passes through the downstream diffuser.

Although widely used, conventional downhole turbomachinery is vulnerable to "gas locking," which occurs in locations where petroleum fluids include a significant gas to liquid ratio. Gas locking often causes the inefficient operation or complete failure of downhole turbomachinery. The gas-locking phenomenon can be explained by the dynamics of fluid flow through the impeller and diffuser. As gas and liquid pass through the channels of a diffuser, its flow directions are guided by curved vanes. The change of flow directions usually generates relatively high and low pressure zones in the flow channels. The streamwise and transverse pressure gradients, streamline curvature and slip between different phases contribute to the segregation of the phases. Gas bubbles tend to move into low pressure zones because of the hydrodynamic behavior of bubbles in liquids. When the two-phase mixtures exit the diffuser, there tend to be more bubbles in the low pressure zones than in the high pressures zones. In severe cases, phase separation can occur in the flow. Upon separation, the gas phase tends to accumulate in certain regions of the flow passage, causing head degradation and gas locking.

In particular, fluid exiting the diffuser and entering the impeller eye often experiences a pressure drop that is usually higher on the shroud side of the vane at the time of entrance to the vanes of the impeller. This pressure drop increases the separation of gas components from liquid components within the fluid. Centrifugal force tends to carry the heavier liquid components to the outer regions of the impeller while the lighter portions concentrate toward the interior of the impeller eye. Gas locking typically begins at the inlet suction side of the vane and extends the accumulation of the increased bubble size to the hub end of the impeller to complete the gas locking of the pumping system.

There is therefore a continued need for an improved pump assembly that effectively and efficiently produces two-phase fluids from subterranean reservoirs. It is to these and other deficiencies in the prior art that the present invention is directed.

SUMMARY OF THE INVENTION

In a preferred embodiment, the present invention includes a centrifugal pump having a rotatable shaft and at least one stage. The at least one stage includes a stationary diffuser and a rotatable impeller connected to the shaft. The at least one stage further comprises a gas accumulation reduction system to reduce the risk of gas locking caused by the accumulation of gas at the inlet of the impeller. The gas accumulation reduction system includes: (i) one or more diffuser ports extending through the diffuser hub; and (ii) one or more recirculation passages extending through the impeller hub. The recirculation passages are in fluid communication with the one or more diffuser ports to permit the recirculation of a portion of pumped fluid through the stage.

In other embodiments, the present invention provides a centrifugal pump that includes at least one turbomachinery stage. The turbomachinery stage includes a stationary diffuser that includes a diffuser hub and a plurality of diffuser vanes. The stage further includes a rotatable impeller that has an impeller hub with a centrally disposed eye and a plurality of impeller vanes. The impeller is variously configured to encourage mixing of two-phase fluids at the eye of the impeller hub.

DETAILED DESCRIPTION OF THE PREFERRED EMBODIMENT

Figure 1:
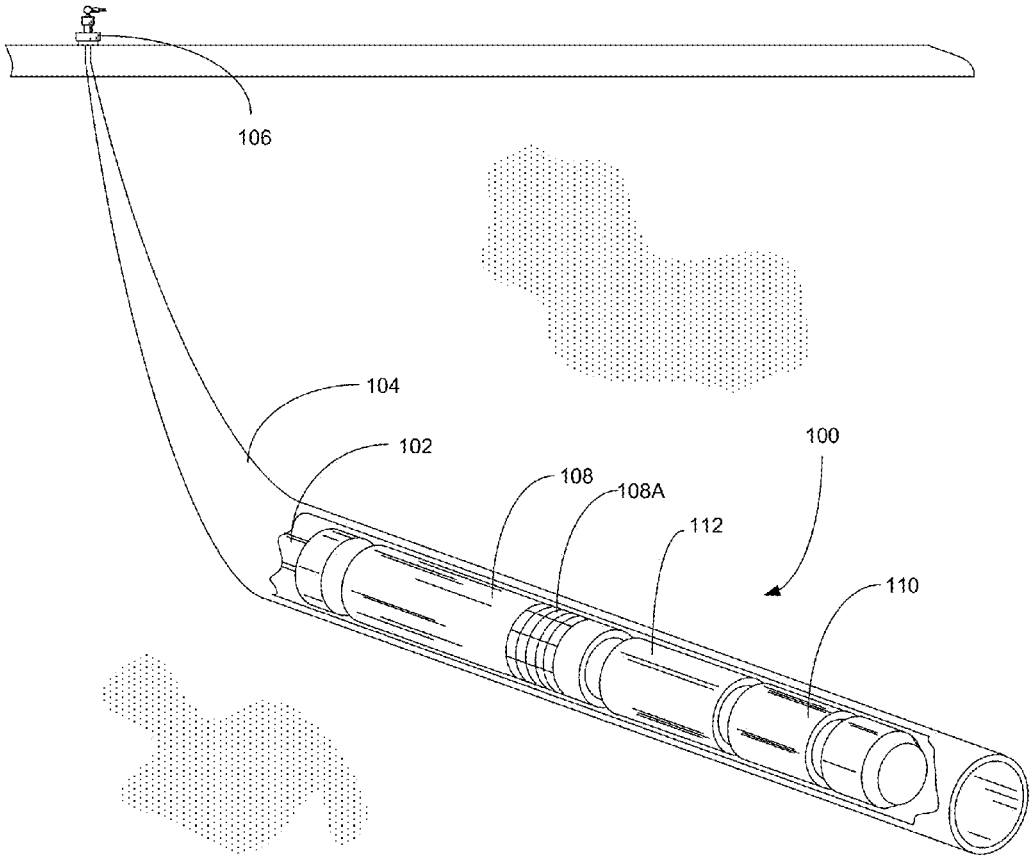
FIG. 1 is a front perspective view of a downhole pumping system in a non-vertical installation.

In accordance with a preferred embodiment of the present invention, FIG. 1 shows a front perspective view of a downhole pumping system 100 attached to production tubing 102. The downhole pumping system 100 and production tubing 102 are disposed in a wellbore 104, which is drilled for the production of a fluid such as water or petroleum. The downhole pumping system 100 is shown in a non-vertical well. This type of well is often referred to as a "horizontal" well.

As used herein, the term "petroleum" refers broadly to all mineral hydrocarbons, such as crude oil, gas and combinations of oil and gas. The production tubing 102 connects the pumping system 100 to a wellhead 106 located on the surface. Although the pumping system 100 is primarily designed to pump petroleum products, it will be understood that the present invention can also be used to move other fluids. It will also be understood that, although each of the components of the pumping system 100 are primarily disclosed in a submersible application, some or all of these components can also be used in surface pumping operations, which may include, for example, the transfer of fluids between storage facilities, the removal of liquid on surface drainage jobs, the withdrawal of liquids from subterranean formations and the injection of fluids into subterranean wells.

The pumping system 100 preferably includes some combination of a pump assembly 108, a pump intake 108*a*, a motor assembly 110 and a seal section 112. In a preferred embodiment, the motor assembly 110 is an electrical motor that receives its power from a surface-based supply. The motor assembly 110 converts the electrical energy into mechanical energy, which is transmitted to the pump assembly 108 by one or more shafts. The pump assembly 108 then transfers a portion of this mechanical energy to fluids within the wellbore, causing the wellbore fluids to move through the production tubing to the surface. In a particularly preferred embodiment, the pump assembly 108 is a turbomachine that uses one or more impellers and diffusers to convert mechanical energy into pressure head.

The seal section 112 shields the motor assembly 110 from mechanical thrust produced by the pump assembly 108. The seal section 112 is also preferably configured to prevent the introduction of contaminants from the wellbore 104 into the motor assembly 110. Although only one pump assembly 108, pump intake 108*a*, seal section 112 and motor assembly 110 are shown, it will be understood that the downhole pumping system 100 could include additional pumps assemblies 108, seals sections 112 or motor assemblies 110.

Figure 2:
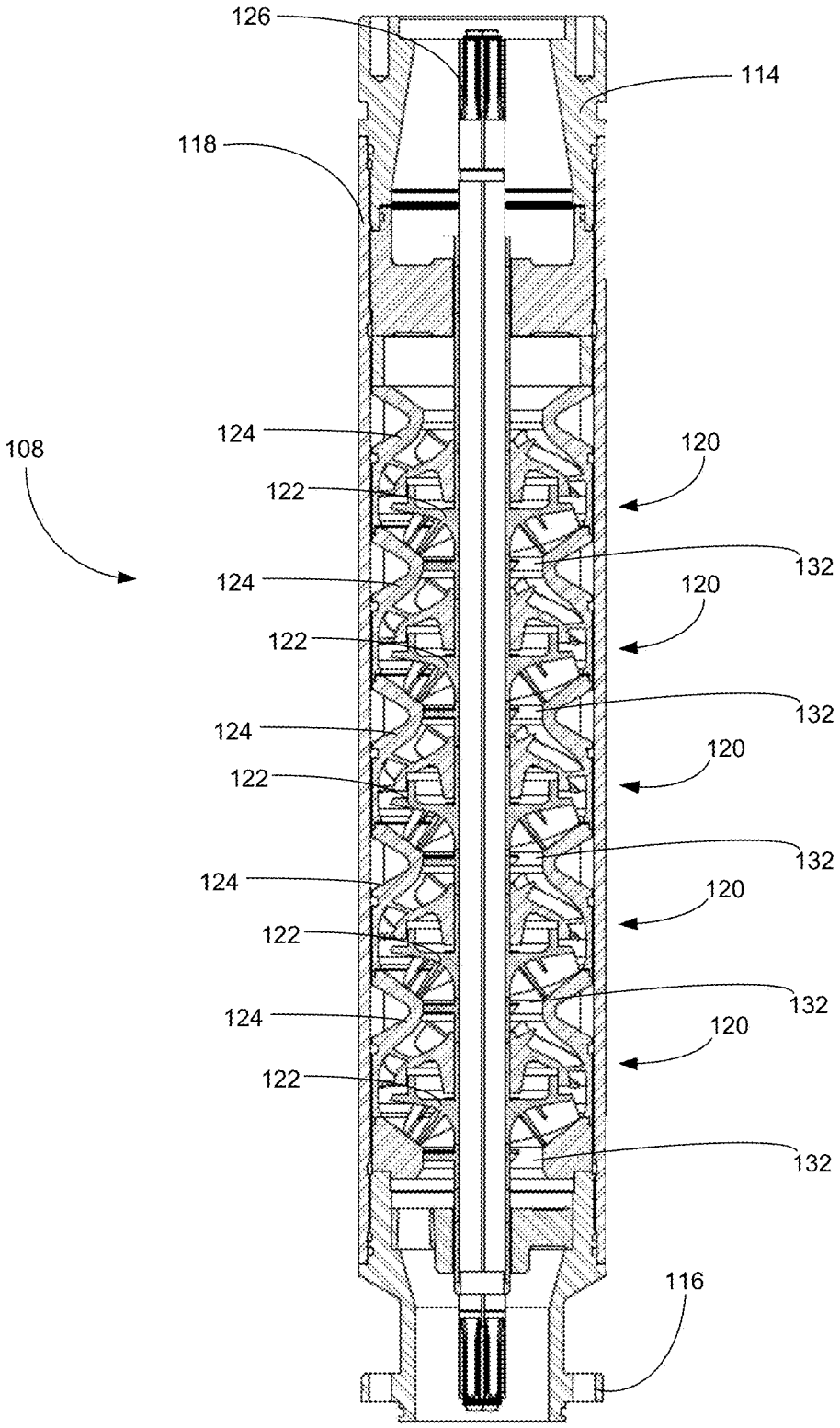
FIG. 2 is a side cross-sectional view of the pump of the submersible pumping system of FIG. 1.

Referring to FIG. 2, shown therein is a cross-sectional view of the pump 108. The pump 108 preferably includes a head 114, a base 116 and a housing 118. In most applications, the head 114 is connected to a pump discharge or directly to the production tubing 102. The base 116 assembled with pump intake 108*a* is typically connected to the seal section 112 or another component with the pumping system 100. However, other arrangements of the pump 108, seal section 112 and motor assembly 110 are contemplated.

The pump 108 further includes one or more turbomachinery stages 120 and a centrally disposed shaft 126 that is configured to rotate about the longitudinal axis of the pump 108. The shaft 126 transfers the mechanical energy from the motor 110 to the working components of the pump 108. The housing 118 and shaft 126 are preferably substantially cylindrical and fabricated from a durable, corrosion-resistant material, such as steel or steel alloy. Unless otherwise specified, each of the components described in the downhole pumping system 100 is constructed from steel, aluminum or other suitable metal alloy or material.

Each stage 120 preferably includes a rotating impeller 122 fixed to the shaft 126 and a stationary diffuser 124 fixed to the housing 118. The impeller 122 and diffuser 124 are preferably fixed to the shaft 126 and housing 118, respectively, with keyed or press-fit connections, although a variety of alternative methods are also acceptable. As addressed herein, novel modifications to the impellers 122 and diffusers 124 have resulted in stages 120 that are well-suited for handling pumped fluids with high gas-to-liquid ratios.

Figure 3:
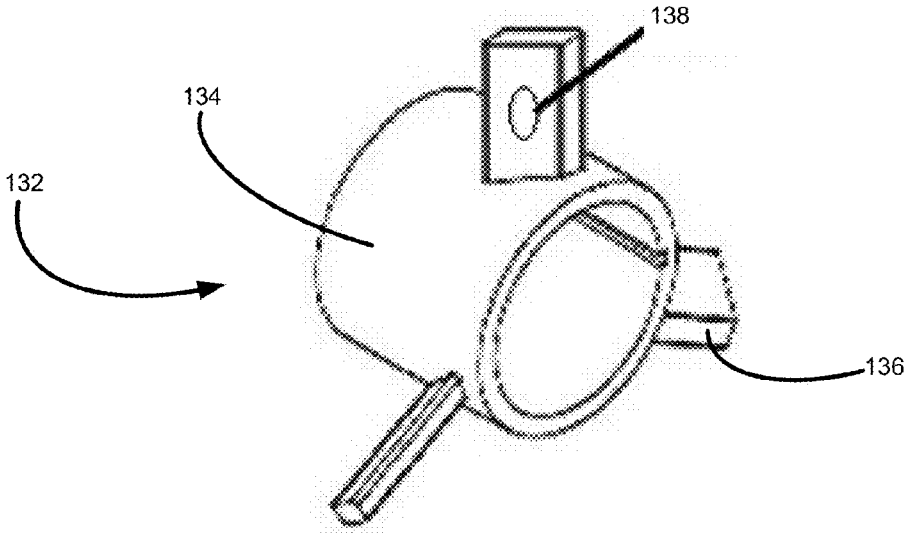
FIG. 3 is a perspective view of a first preferred embodiment of a multiphase homogenizer.
Figure 4:
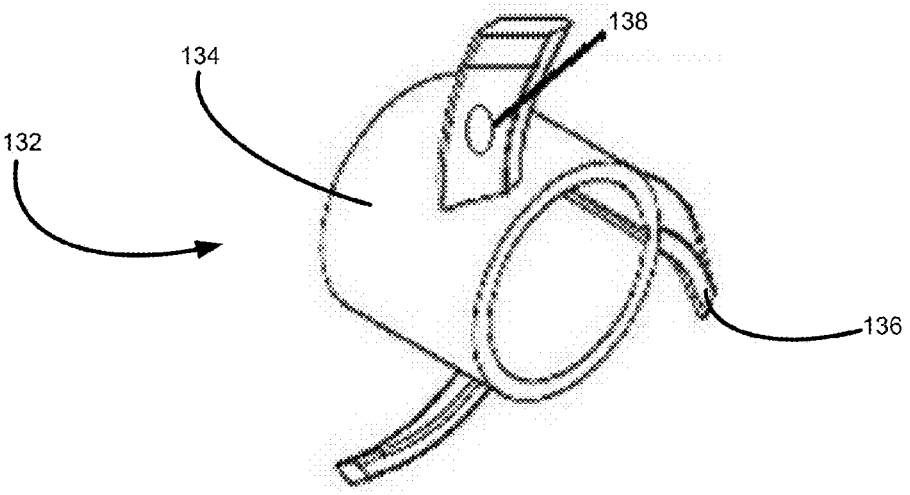
FIG. 4 is a perspective view of a second preferred embodiment of a multiphase homogenizer.

Continuing with FIG. 2, the pump assembly 108 also includes a fluid homogenizer 132. Turning to FIGS. 3 and 4, shown therein are perspective views of first and second embodiments, respectively, of the homogenizer 132. The homogenizer 132 includes a homogenizer hub 134 and a plurality of homogenizer blades 136 attached to the homogenizer hub 134. The homogenizer hub 134 is preferably keyed to the shaft 126 so that the homogenizer 132 rotates with the shaft 126. In the embodiment depicted in FIG. 3, the homogenizer blades 136 are straight and include a homogenizer blade hole 138. In contrast, the homogenizer blades 136 of the homogenizer 132 depicted in FIG. 4 are curved.

The homogenizer 132 includes a minimum of two homogenizer blades 136 and more preferably includes between three and eight homogenizer blades 136. The homogenizer blades 136 are preferably set at a minimum pitch (vane angle) of 10 degrees and a maximum vane angle of 90 degrees. The homogenizer 132 is configured so that the homogenizer blades 136 cause the pumped fluid to rotate in the same direction of rotation as the impellers 122. The homogenizer 132 optionally includes one or more blade holes 138 within the homogenizer blades 136. Each blade hole 138 is used to further increase mixing and prevents the rotation of the entire fluid mass at the entrance of the downstream impeller 122. In a particularly preferred embodiment, the optimum width of the vanes should be limited to the length to radius ratio (L/R) of less than one.

In the presently preferred embodiment depicted in FIG. 2, the homogenizer 132 is positioned at the inlet of the pump assembly 108. The homogenizer 132 is used to break up and disperse any large gas bubbles or slugs before the fluid passes into the first stage 120. It will be appreciated, however, that additional homogenizers may be used throughout the pump assembly 108 to further homogenize and blend the gas and liquid components of a multiphase fluid.

Figure 5:
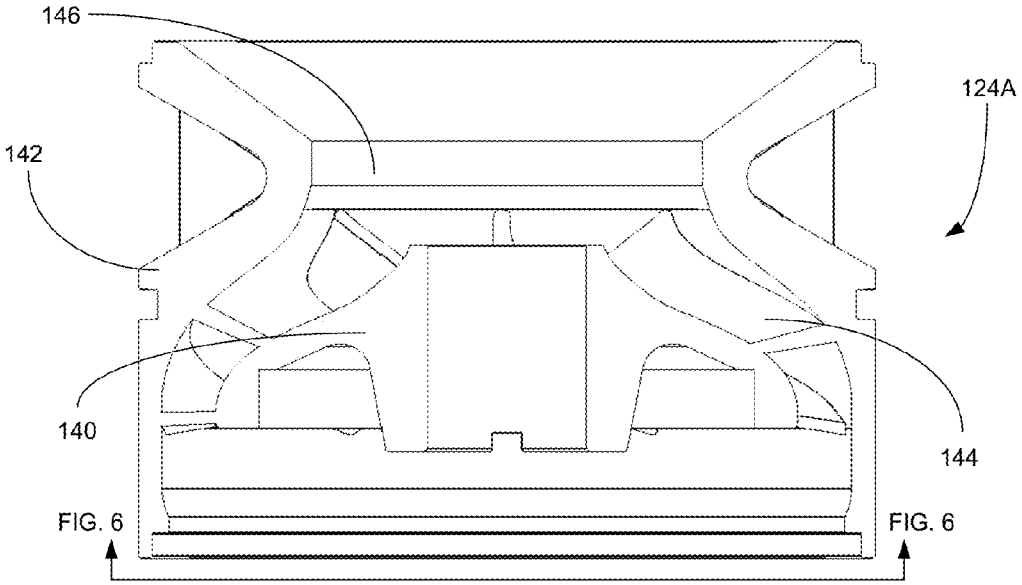
FIG. 5 is a cross-sectional view of a diffuser constructed in accordance with a first preferred embodiment.
Figure 6:
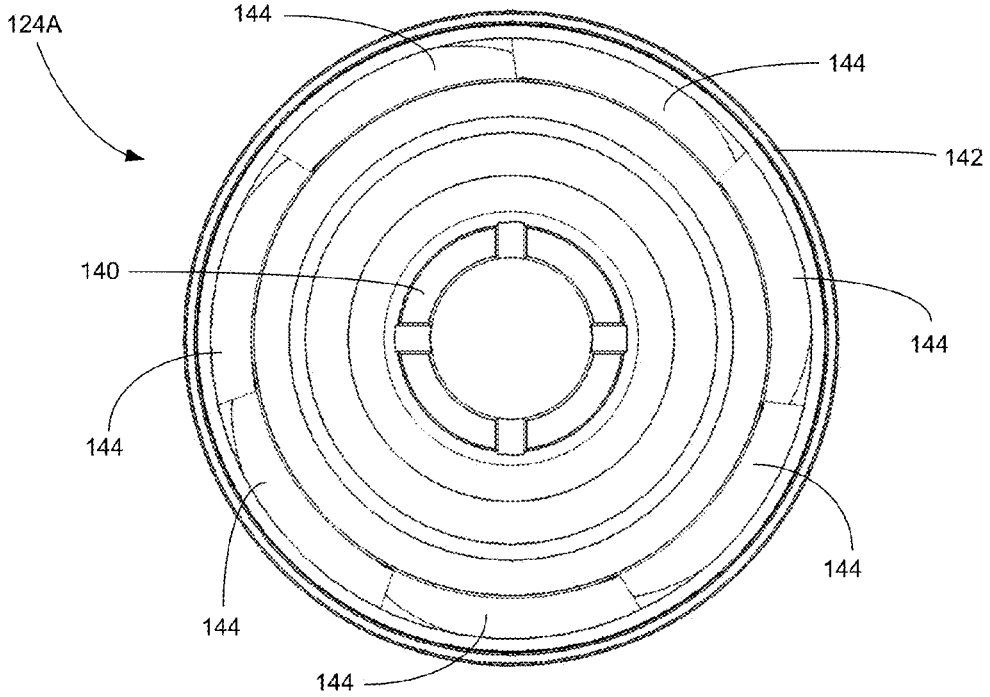
FIG. 6 is an upstream view of the diffuser of FIG. 5.

Turning to FIGS. 5 and 6, shown therein are cross-sectional and upstream views of a diffuser 124A constructed in accordance with a first preferred embodiment. The diffuser 124A includes a diffuser hub 140, a diffuser shroud 142 and a plurality of diffuser vanes 144. The diffuser shroud 142 is configured to fit within the inner surface of the housing 118 (not shown in FIGS. 5-6). As one of ordinary skill in the art will recognize, the number and design of the plurality of diffuser vanes 144 is based on application-specific requirements and not limited by the present invention. In preferred embodiments, each diffuser 124 includes between 3 to 10 diffuser vanes 144.

The profile of the outer diameter of the diffuser hub 140 and the inner diameter of the diffuser shroud 142 are formed by the revolution of at least one line segment that is inclined at an angle to the longitudinal axis of the diffuser 124A. As best illustrated in the cross-sectional view of FIG. 5, in the preferred embodiment, the profile of the diffuser hub 140 resembles a truncated conical form with a linearly decreasing outer diameter in the downstream direction. The inner diameter of the diffuser shroud 142 follows the profile of the diffuser hub 140 to create a downstream throat 146. Fluid passing through the throat 146 tends to decelerate as it exits the diffuser 124.

Referring generally to FIGS. 7-15, shown therein are various depictions of impellers 122 constructed in accordance with preferred embodiments. Each of the impellers 122 includes one or more features that are designed to improve resistance to gas locking in the presence of high gas-to-liquid ratios. Each impeller 122 generally includes an impeller hub 148 and a plurality of impeller vanes 150. In the presently preferred embodiment, the impeller vanes 150 are configured as spiraled, overlapping flights. Vane angles can vary from a minimum of about 5 degrees to about 25 degrees at the inlet of the impeller 122, with a maximum of about 50 degrees at the discharge of the impeller 122. Although not so required, each impeller 122 preferably includes between 2 and 8 vanes. Each impeller 122 includes an impeller eye 149 that constitutes the space between the impeller hub 148 and the leading edge of the impeller vanes 150.

Figure 7:
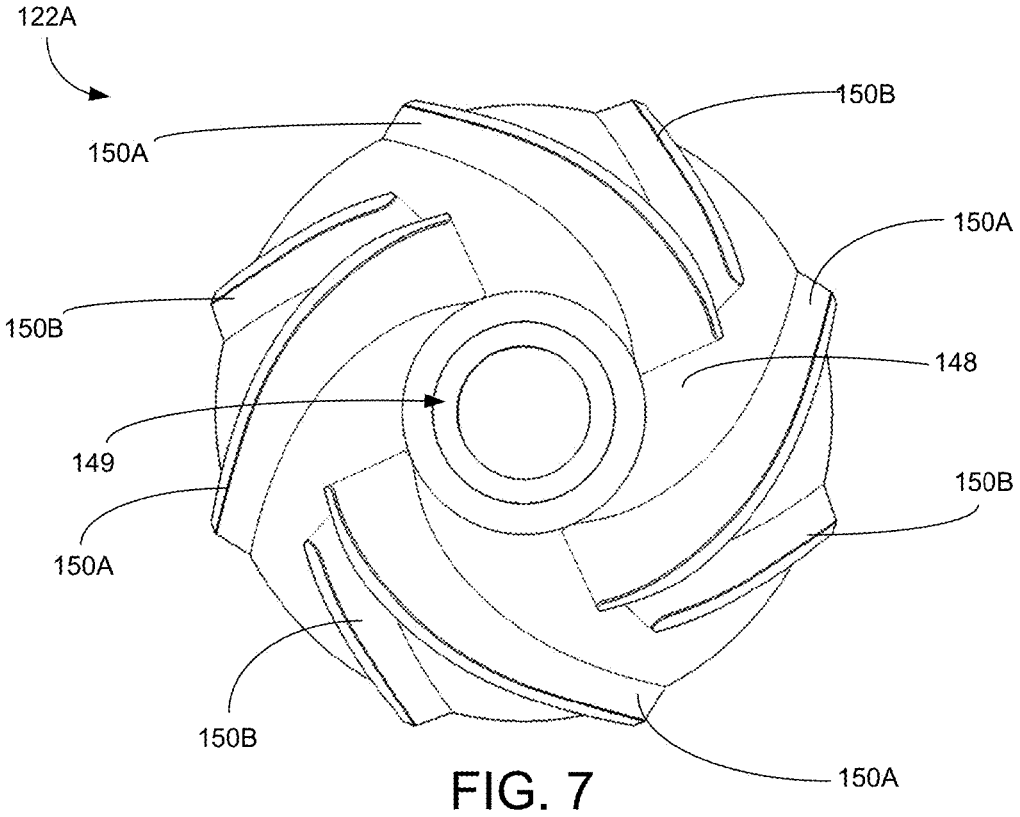
FIG. 7 is an upstream view of an impeller constructed in accordance with a first preferred embodiment.
Figure 8:
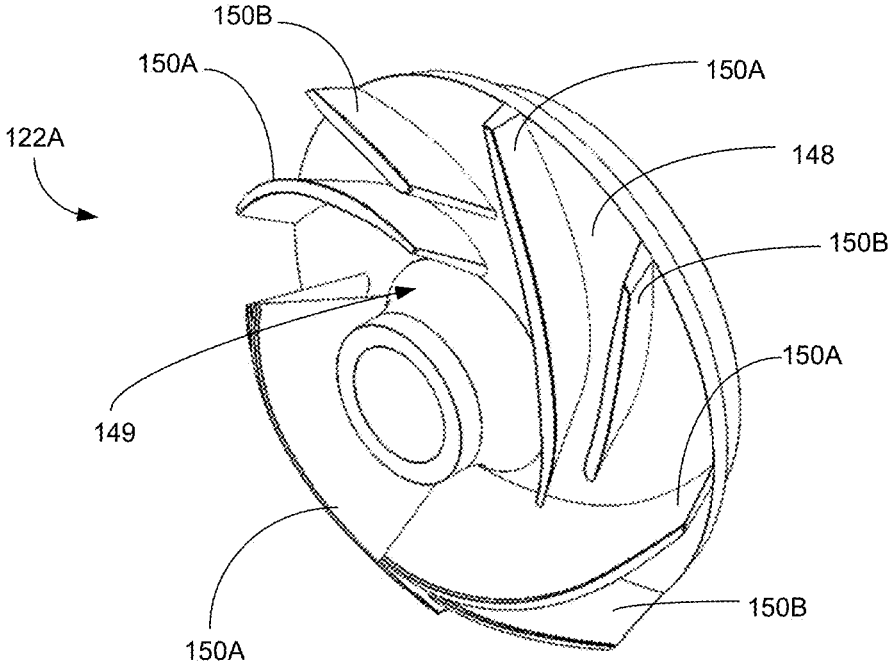
FIG. 8 is a perspective view of the impeller of FIG. 7.

In the particularly preferred embodiment depicted in FIGS. 7-8, the impeller 122A includes a series of primary impeller vanes 150A and series of secondary impeller vanes 150B. The primary impeller vanes 150A extend from the eye 149 of the impeller hub 148 to the edge of the impeller 122. The secondary vanes 150B are shorter and positioned outside the primary impeller vanes 150A. The secondary vanes 150B extend radially outward from a middle portion of the impeller hub 148. The use of the primary and secondary impeller vanes 150A, 150B decreases the number of vanes near the eye 149 of the impeller hub 148 which in turn reduces the risk of trapping gas bubbles near the eye of the impeller hub 148.

Notably, the embodiment of the impeller 122A depicted in FIGS. 7 and 8 is an "open impeller" that does not include a shroud on the upstream side of the vanes 150. By removing the shroud that is typically found on impellers, the impeller 122A is capable of running in close tolerance with the downstream side of the diffuser 124. Minimizing the distance between the diffuser 124 and impeller 122A further reduces the risk of gas locking by removing an area of low pressure between the discharge of the diffuser 124 and the suction inlet of the impeller 122A. The smaller space between the diffuser 124 and impeller 122A also reduces the area in which gas bubbles may accumulate.

Figure 9:
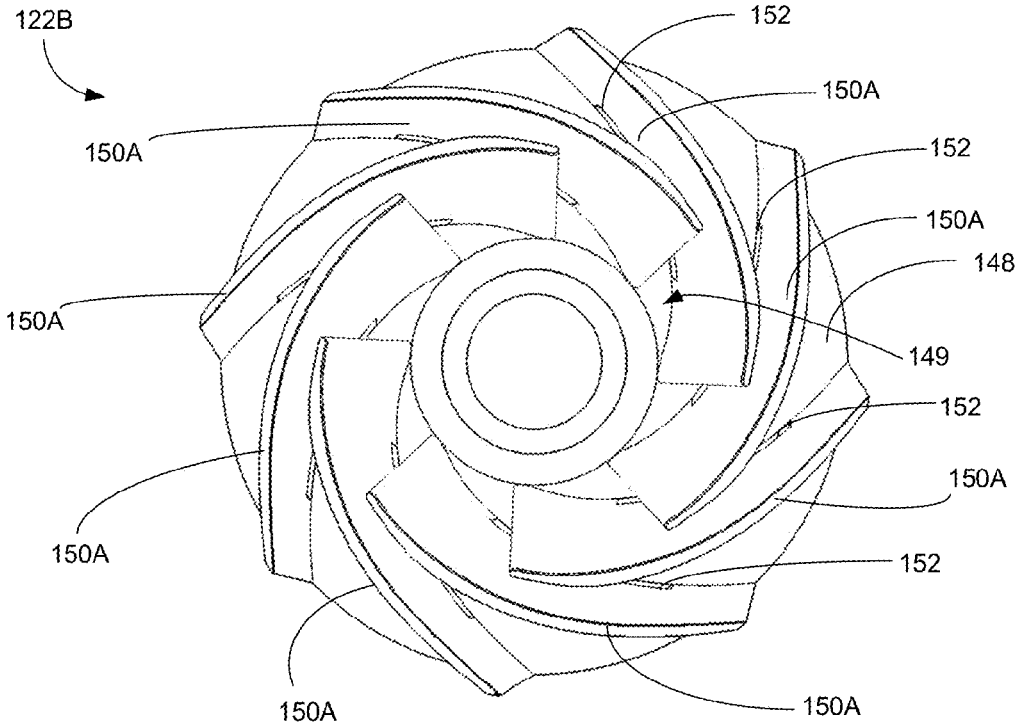
FIG. 9 is an upstream view of an impeller constructed in accordance with a second preferred embodiment.
Figure 10:
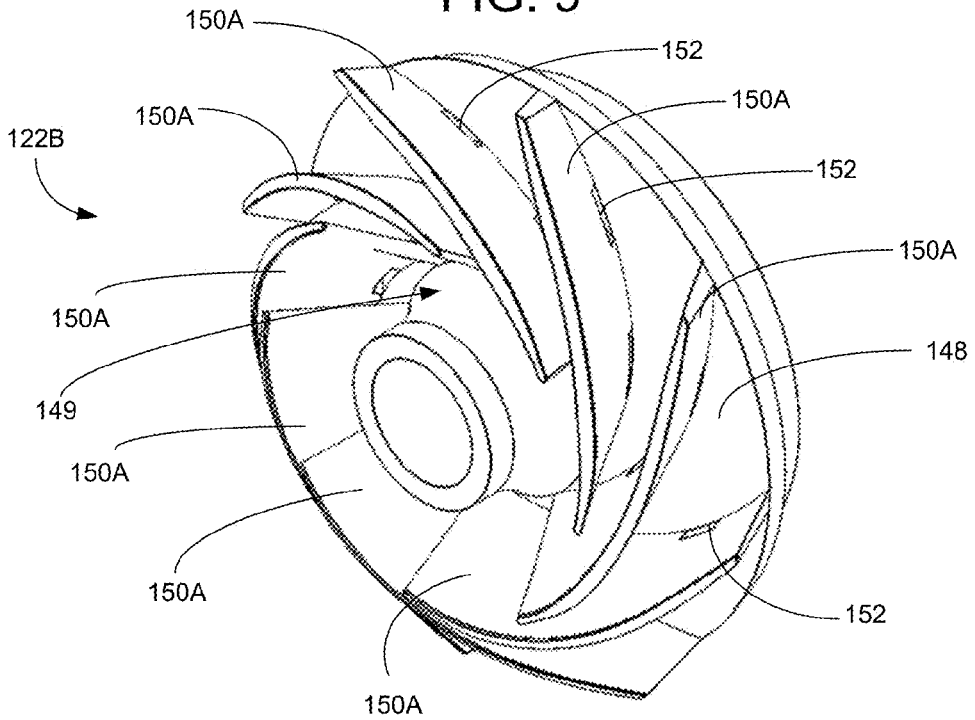
FIG. 10 is a perspective view of the impeller of FIG. 9.

Turning to FIGS. 9 and 10, shown therein are front and perspective upstream views of an impeller 122B constructed in accordance with a second preferred embodiment. In the second preferred embodiment depicted in FIGS. 9 and 10, a series of primary vanes 150A extends from the eye 149 of the impeller hub 148 to the discharge edge of the impeller 122B. In the embodiment depicted in FIGS. 9 and 10, the secondary impeller vanes 150B have been eliminated. The impeller 122B is an open impeller that does not include a shroud on the upstream edge of the primary vanes 150A.

The primary vanes 150A include two or more vane slots 152. The vane slots 152 contribute to mixing by allowing a portion of the pumped fluid to pass through the vane 150A. The mixing provided by the vane slots 152 helps to maintain a homogenous gas-liquid mixture as the fluid passes through the impeller 122B. Although two vane slots 152 are shown on each vane 150A in FIGS. 9 and 10, it will be appreciated that fewer or additional vane slots 152 may be incorporated within each vane 150A. Alternatively, it may be desirable to include the vane slots 152 on less than all of the vanes 150A.

Figure 11:
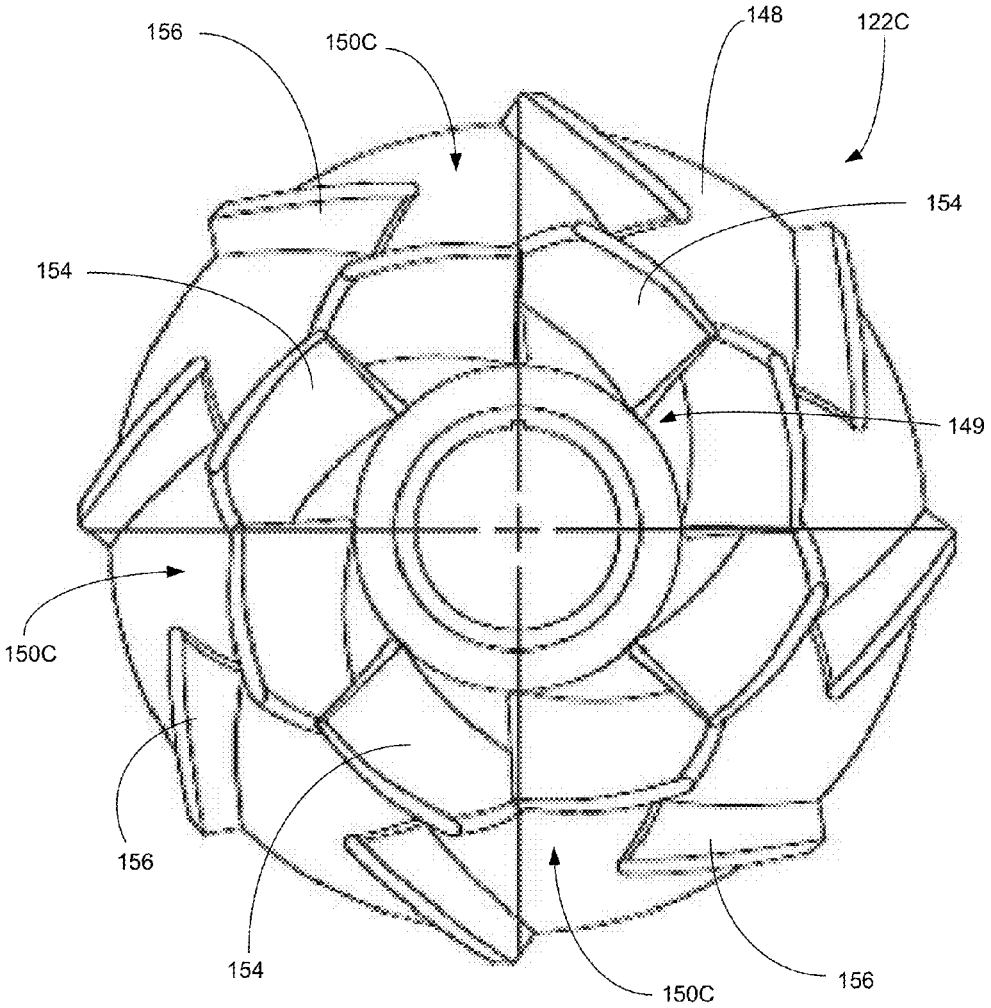
FIG. 11 is an upstream view of an impeller constructed in accordance with a third preferred embodiment.

Turning to FIG. 11, shown therein is a front upstream view of an impeller 122C constructed in accordance with a third preferred embodiment. The impeller 122C includes a series of splitter vanes 150C disposed in a radial array around the eye 149 of the impeller hub 148. Each splitter vane 150C includes a central portion 154 and a radial portion 156 extending along the exterior of the impeller 122C. The impeller 122C is an open impeller that does not include a shroud along the upstream side of the central portion 154 or the radial portion 156 of the splitter vanes 150C. The splitter vanes 150C were designed by taking a conventional vane and removing the middle portion of the vane to create two, spaced-apart sections. The spaced apart central portion 154 and radial portion 156 of the splitter vanes 150C provides homogenization of the gas and liquid components of the fluid passing through the impeller 122C.

Figure 12:
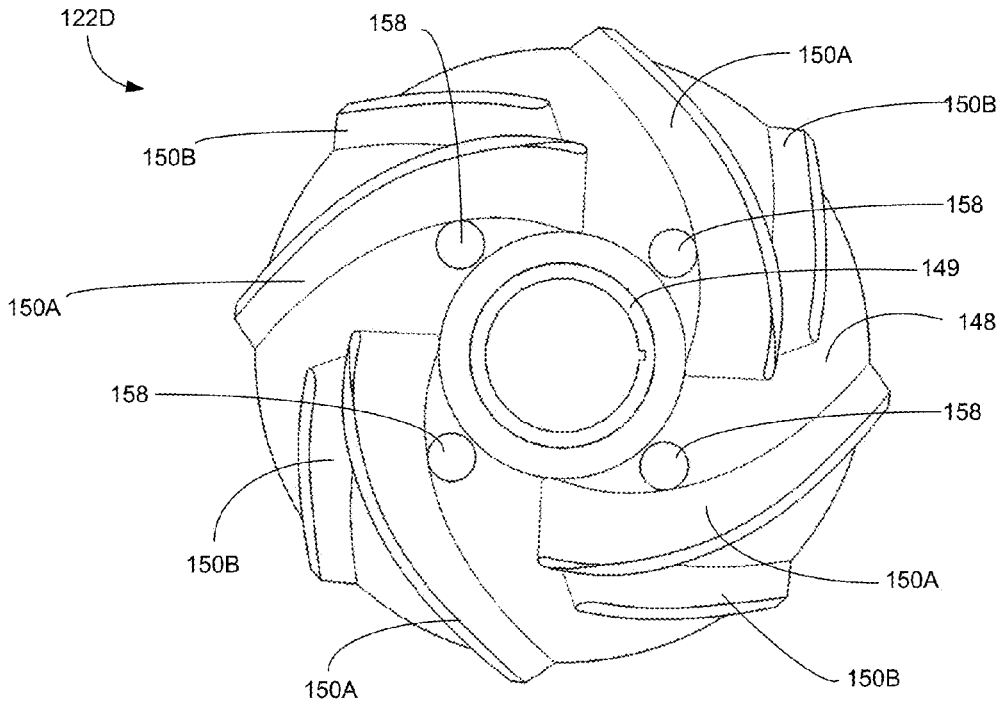
FIG. 12 is an upstream view of an impeller constructed in accordance with a fourth preferred embodiment.

Turning to FIG. 12, shown therein is a front upstream view of an impeller 122D constructed in accordance with a fourth preferred embodiment. In the fourth preferred embodiment, the impeller 122D is an open (shroudless) impeller that includes a series of primary vanes 150A and secondary vanes 150B. The impeller 122D includes one or more recirculation passages 158 (four are shown in FIG. 12). The recirculation passages 158 pass through the impeller 122D so that a portion of the pumped fluid from the downstream, high-pressure portion of the impeller 122D returns to the upstream, lower pressure face of the impeller 122D. This recirculation of a portion of the pumped fluid further increases homogenization of the fluid. Significantly, the returned fluid is injected near the eye 149 of the hub 148, where gas bubbles tend to accumulate. The injection of recirculated fluid at the eye 149 of the hub 148 further reduces the risk of gas bubble accumulation at the inlet of the impeller 122D.

Figure 13:
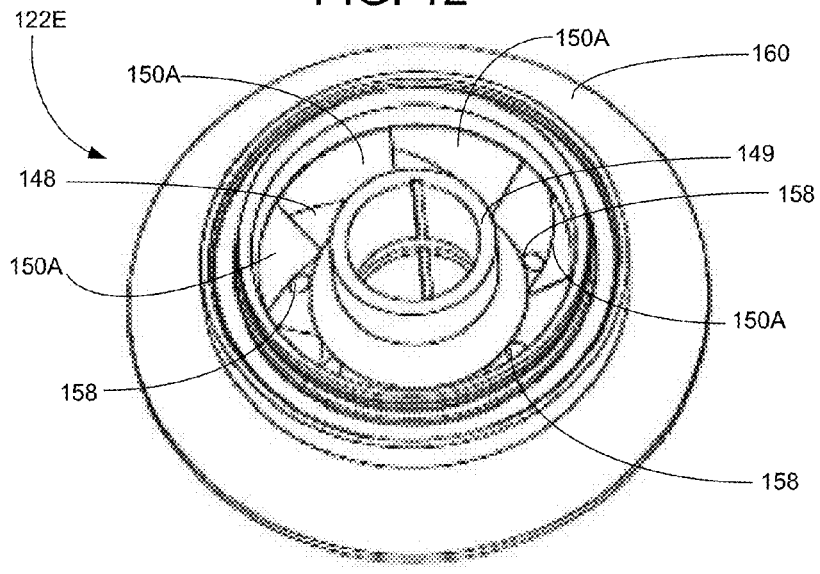
FIG. 13 is a perspective view of an impeller constructed in accordance with a fifth preferred embodiment.

Turning to FIG. 13, shown therein is an upstream perspective view of an impeller 122E constructed in accordance with a fifth preferred embodiment. In the fifth preferred embodiment, the impeller 122E includes a partial shroud 160 extending across the primary vanes 150A. The impeller 122E provides the combination of the shroud 160 with the recirculation passages 158.

Figure 14:
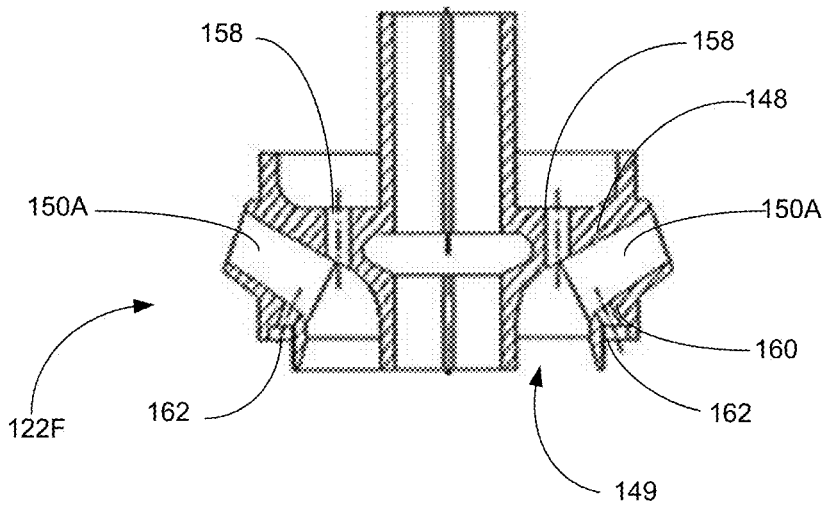
FIG. 14 is a side cross-sectional view of an impeller constructed in accordance with a sixth preferred embodiment.
Figure 15:
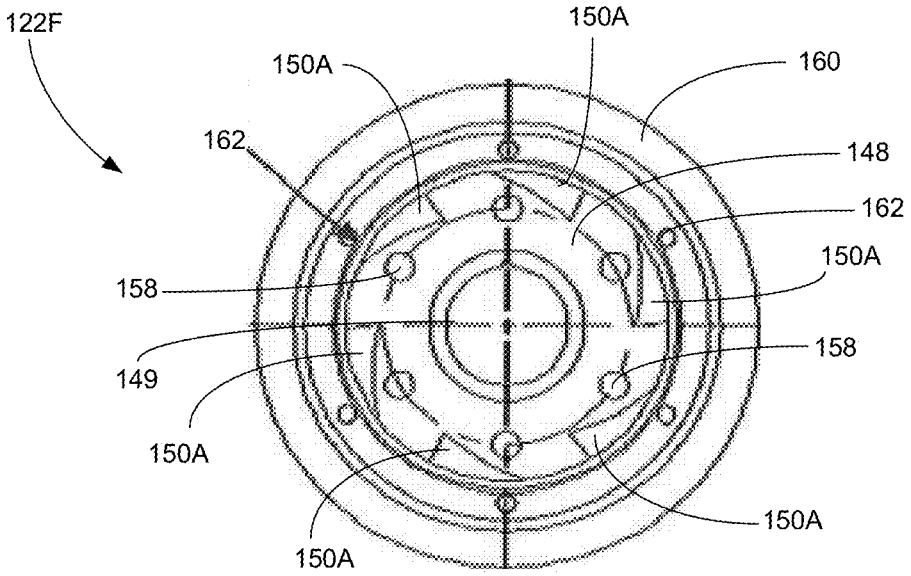
FIG. 15 is an upstream view of the impeller of FIG. 14.

Turning to FIGS. 14-15, shown therein are cross-sectional and front views, respectively, of an impeller 122F constructed in accordance with a sixth preferred embodiment. In the sixth preferred embodiment, the impeller 122F includes a shroud partial 160 and recirculation passages 158. In addition to the recirculation passages 158, the impeller 122F further includes shroud apertures 162. Like the recirculation passages 158, the shroud apertures 162 provide a bypass through which a portion of the pumped fluid returns to the face of the impeller 122F. The recirculation of fluid to the inlet of the impeller 122F increases turbulence and discourages the accumulation of the gas at the suction side of the impeller 122F.

Figure 16:
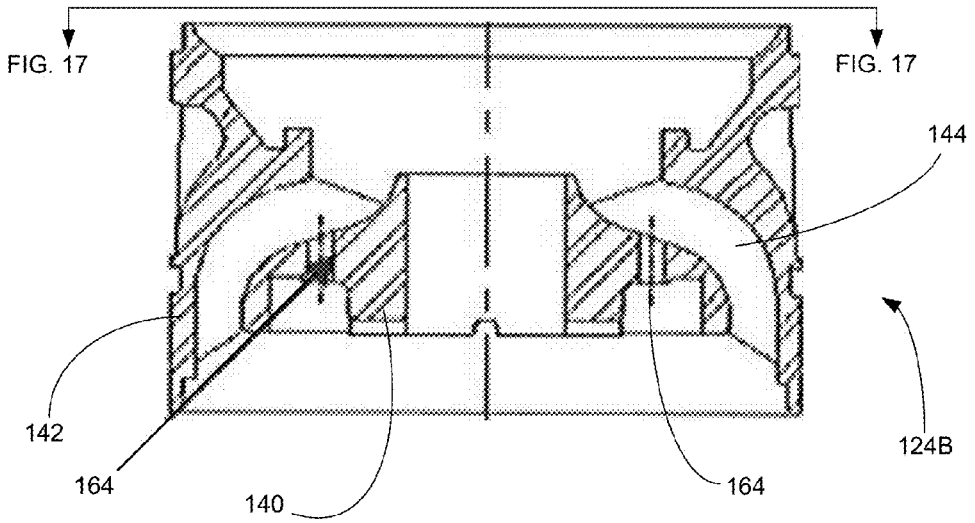
FIG. 16 is a side cross-sectional view of a diffuser constructed in accordance with a second preferred embodiment.
Figure 17:
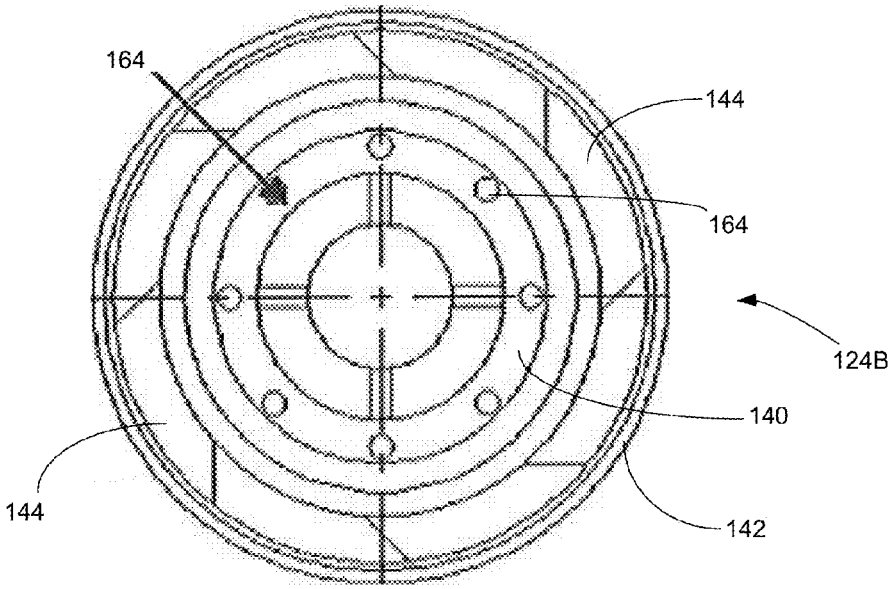
FIG. 17 is an upstream view of the diffuser of FIG. 16.

Turning to FIGS. 16-17, shown therein are cross-sectional and upstream views, respectively, of a diffuser 124B constructed in accordance with a second preferred embodiment of the present invention. The diffuser 124B includes diffuser ports 164 that extend through the diffuser hub 140. The diffuser ports 164 allow a portion of the pumped fluid to bypass the diffuser vanes 144, thereby increasing the turbulence and mixing at the downstream side of the diffuser 124B. The increased turbulence further counteracts the accumulation and separation of large gas pockets within the stage 120.

Figure 18:
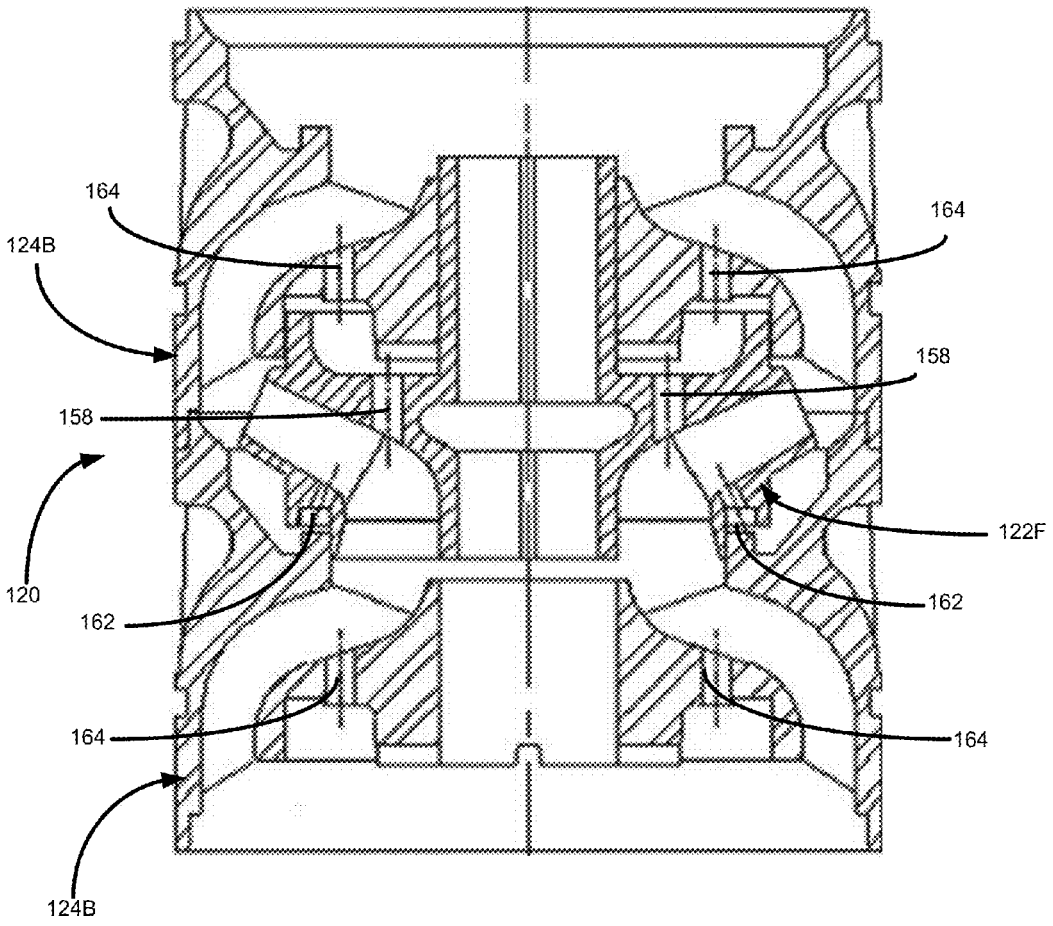
FIG. 18 is a cross-sectional view of a stage constructed in accordance with a presently preferred embodiment.

Turning to FIG. 18, shown therein is a cross-sectional view of a stage 120 constructed in accordance with a preferred embodiment. The stage 120 includes two diffusers 124B surrounding an impeller 122F. The impeller 122F and diffuser 124B are each provided with bypass routes that allow fluid to be recirculated through the stage 120 to improve homogenization. As noted in FIG. 18, a portion of the fluid entering the upstream side of the diffuser 124B passes through the diffuser ports 164 directly into the suction side of the impeller 122F. As the impeller 122F imparts kinetic energy into the fluid, a portion is passed around the outside of the impeller 122F through the shroud apertures 162. Additionally, higher pressure fluid from the downstream diffuser 124B is passed back through the diffuser ports 164 to the suction inlet of the impeller 122F through the recirculation passages 158. The bypass and recirculation at the interface between the impeller 122F and diffuser 124B significantly reduces the accumulation of gas pockets and increases the resistance of the pump 108 to gas locking.

Although various features of the preferred embodiments have been depicted separately, it will be understood that it is contemplated that any number of combinations of these features is encompassed within the scope of the present invention. For example, it may be desirable to employ a shroudless impeller 122A in combination with the diffuser 122B that includes diffuser ports 164. Similarly, it may be desirable to mix-and-match different features within a single pump assembly. In a presently preferred embodiment, the stages 120 positioned near the base 116 of the pump 108 are provided with impellers 122 that include vane slots 152 in combination with diffusers 124 that incorporate diffuser ports 164. The collection of these features collectively comprises an improved solution for reliably pumping fluids with a high or variable gas-to-liquid ratio.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A centrifugal pump having a rotatable shaft and at least one turbomachinery stage, wherein the at least one turbomachinery stage comprises:

a stationary diffuser having a plurality of diffuser vanes;

a rotatable impeller connected to the shaft, wherein the impeller has an impeller hub, an upstream side and a downstream side, wherein the downstream side is adjacent to the stationary diffuser; and a gas accumulation reduction system, wherein the gas accumulation reduction system comprises:

one or more diffuser ports, wherein each of the one or more diffuser ports extends from one of the plurality of diffuser vanes through the diffuser hub to the downstream side of the impeller; and one or more recirculation passages extending through the impeller hub from the downstream side of the impeller to the upstream side of the impeller, and wherein the recirculation passages are in fluid communication with the one or more diffuser ports.

* * * * *